US006488013B2

(12) United States Patent
Boecking

(10) Patent No.: US 6,488,013 B2
(45) Date of Patent: Dec. 3, 2002

(54) INJECTOR WITH CENTRAL HIGH-PRESSURE CONNECTION

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/887,096

(22) Filed: Jun. 25, 2001

(65) Prior Publication Data

US 2002/0020395 A1 Feb. 21, 2002

(30) Foreign Application Priority Data

Jun. 29, 2000 (DE) ..... 100 31 571

(51) Int. Cl.[7] ..... F02M 37/04
(52) U.S. Cl. ..... 123/467; 239/96
(58) Field of Search ..... 123/456, 468, 123/469, 467; 239/88–96

(56) References Cited

U.S. PATENT DOCUMENTS 4,848,658 A * 7/1989 Aketa et al. ..... 239/96
6,318,341 B1 * 11/2001 Gmelin et al. ..... 123/456

* cited by examiner

*Primary Examiner*—Thomas N. Moulis
(74) *Attorney, Agent, or Firm*—Ronald E. Greigg

(57) ABSTRACT

The invention relates to an injector for injecting fuel, which is under extremely high pressure, into the combustion chambers of an internal combustion engine. A valve body is provided, which opens and closes a valve chamber received in the injector housing, and an inlet leads from the valve body to the injection nozzle. For actuating the valve body, a control chamber of the injector housing is pressure-relieved by means of a control element. The inlet originating at the high-pressure collection chamber (common rail), extends centrally through the valve body, which is received movably in the injector housing.

10 Claims, 1 Drawing Sheet

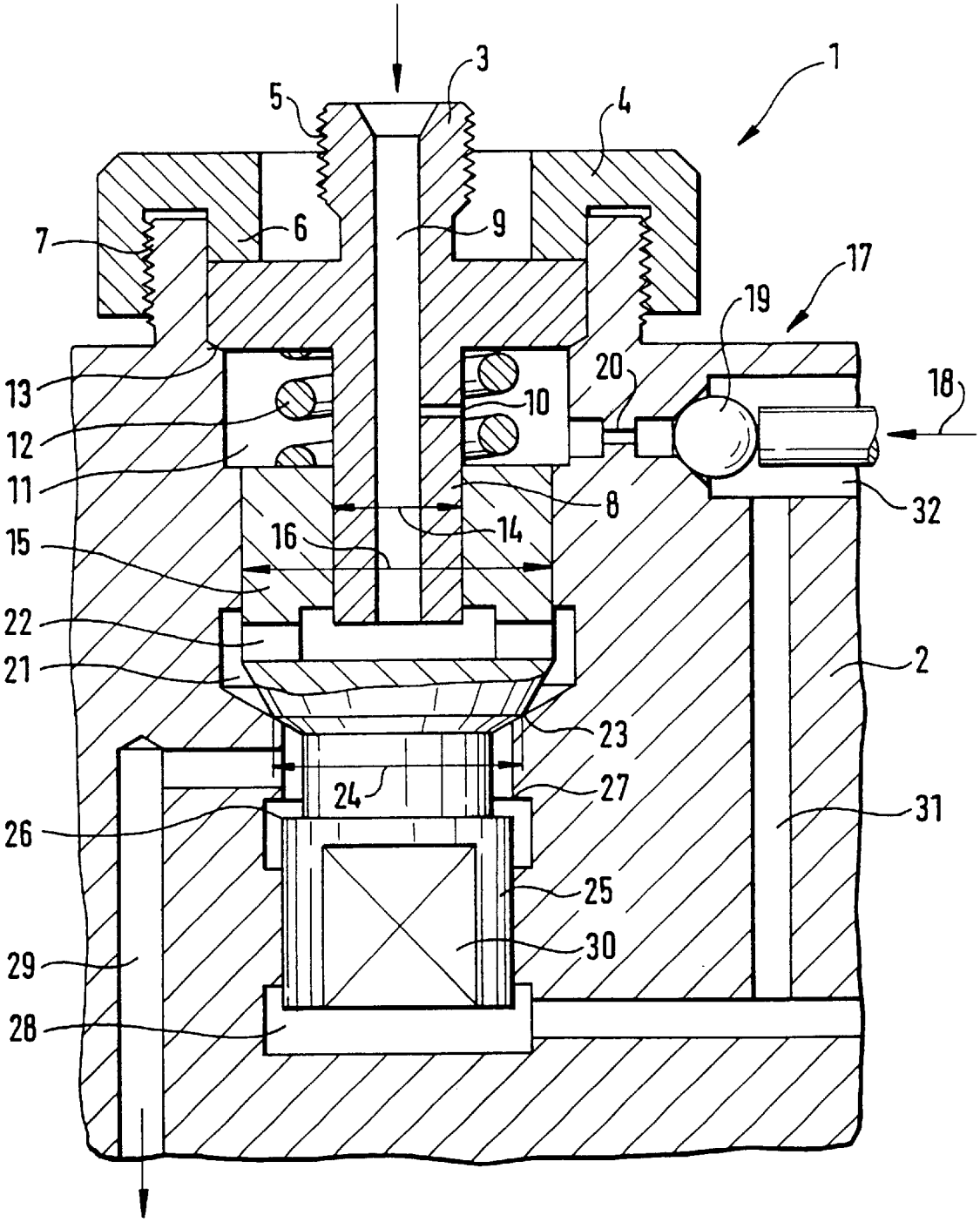
1
2
3
4
5
6
7
8
9
10
11
12
13
14
15
16
17
18
19
20
21
22
23
24
25
26
27
28
29
30
31
32

INJECTOR WITH CENTRAL HIGH-PRESSURE CONNECTION

BACKGROUND OF INVENTION

1. Field of the Invention

In direct-injection internal combustion engines, injectors are known and used to inject the fuel, which is at very high pressure, into the combustion chambers of internal combustion engines. In injection systems with high-pressure collection chambers (common rails), the inlet lines usually discharge laterally in the housing of the injector body, where they take up space, since the inlets originating at the high-pressure collection chamber leading to the individual injectors for the cylinders of a direct-injection engine must be embodied with enough strength to permanently withstand the high pressures that occur.

2. Description of the Prior Art

German Patent Disclosure DE 198 35 494 A1 relates to a unit fuel injector. The unit fuel injector serves to supply fuel to a combustion chamber of direct-injection internal combustion engines, with a pump unit for building up an injection pressure and for injecting the fuel into the combustion chamber via an injection nozzle. A control unit is also provided, which acts on a control valve embodied as an outward-opening A valve, and a valve actuation unit is also provided, for controlling the pressure buildup in the pump unit. To create a unit fuel injector with a control unit that has a simple design, is small in size, and in particular has a fast response time, the disclosure proposes that the valve actuation unit be embodied as a piezoelectric actuator.

German Patent DE 37 28 817 C2 relates to a fuel injection pump for an internal combustion engine. In a fuel injection pump, the control valve member is embodied of a valve shaft, which forms a guide sleeve and slides in a conduit, and a valve head connected to the valve shaft and oriented toward the actuation device. The sealing face of the valve head cooperates with the face of the control bore that forms the valve seat. The valve shaft, on its circumference, has a recess whose axial length extends from the inlet orifice of the fuel supply line to the beginning of the sealing face, cooperating with the valve seat, at the valve head. A face exposed to the pressure of the fuel supply line is formed in the recess and is equal in area to a face of the valve head that in the closed state of the control valve is exposed to the pressure of the fuel supply line, and as a result, in the closed state the valve is pressure-balanced. A spring that urges the control valve to its opening position is disposed in the guide sleeve.

OBJECT AND SUMMARY OF THE INVENTION

The available space in the cylinder head region of motor vehicle internal combustion engines is extremely scarce. When the injector proposed by the invention is used to inject fuel that is at high pressure into the combustion chambers of an internal combustion engine, the injector can be designed in a more space-saving way, so that less installation space is needed in the cylinder head region of an internal combustion engine. Moreover, the injector body or in other words the housing of the injector can now be designed and produced much more economically, since the inlet, to be provided laterally on the housing and integrated with the housing, for the inlet line to the high-pressure collection chamber can now be omitted. The connection of the inlet line, originating at the high-pressure collection chamber, can be made substantially more economical by means of a screw fastening element that permanently withstands the incident high pressures.

The accessibility of the injector housing from above exists without requiring that the entire injector body housing be removed in the cylinder head region of an internal combustion engine. Once the inlet line from the high-pressure collection chamber has been unscrewed, a lock nut can very easily be unscrewed from the injector housing, so that the control part can be removed without problems from the injector housing, should that be necessary in an individual case.

Integrating the control chamber between the control part and a central high-pressure connection, provided with a male thread, for connecting the inlet from the high-pressure collection chamber makes it possible to embody the control slide substantially more compactly, resulting in a lower structural height of the injector body housing proposed according to the invention. The spring element that acts on the valve body is let into the control chamber, and the control volume can be reduced by integrating this spring element with the control chamber. A throttle element—embodied as a simple through bore—is provided in the wall of the male-threaded central connection element for the inlet from the high-pressure collection chamber, and with this through bore the high-pressure collection chamber can be acted upon by the fuel supply that forms the control volume. The male-threaded connection piece, acting as a central connection to the high-pressure collection chamber, serves with its extension embodied below the inlet throttle as a guide for the valve body. Upon pressure relief of the control chamber by triggering of a piezoelectric actuator or electromagnet, the valve body, upon pressure relief of the control chamber by the actuator-actuated control element, is guided and centered at the extension of the central high-pressure collection chamber connection piece.

BRIEF DESCRIPTION OF THE DRAWING

The invention will be better understood and further objects and advantages thereof will become more apparent from the ensuing detailed description of a preferred embodiment taken in conjunction with the drawing, in which the sole FIGURE is a sectional view of an injector housing, configured according to the invention, with a central connection piece, let into it, for the inlet from the high-pressure collection chamber, at which connection piece a compression spring-actuated control part is movable in the vertical direction.

DESCRIPTION OF THE PREFERRED EMBODIMENT

The drawing shows a longitudinal section through the injector housing, proposed according to the invention, of an injector for injecting fuel that is at high pressure into combustion chambers of an internal combustion engine.

The injector 1 as shown in longitudinal section essentially includes an injector housing 2, with a valve body 15 let into it, see the reference FIGURE. A rotationally symmetrically embodied connection element 3 serving as a central connection piece for the inlet from the high-pressure collection chamber is let into the injector housing 2 in the upper region of the valve body 2. The essentially rotationally symmetrically embodied connection element 3 is provided on its upper portion with a male thread 5, to which an inlet line that originates at the high-pressure collection chamber (common rail) can be connected. The connection element 3 is pierced, coaxially to its access of symmetry, by an inlet bore 9, which discharges into a transverse bore 22 in the valve body 15 that in turn communicates with the valve chamber 21 embodied in the injector housing 2. Via the inlet bore 9 that extends through the central connection element 3, the valve chamber 21 of the injector housing 2 is constantly acted upon by fuel that is at high pressure.

The central connection element 3 is embodied, in its widened region, with a sealing edge 13. Via a lock nut 4, embodied for instance as a union nut with a union ring 6, the central connection element 3 can be screwed to the injector housing 2 in such a way that the sealing edge 13 is pressed sealingly into its seat in the housing 2 and thus seals off the control chamber 11, defined by it, from leakage. The lock nut 4 and the union ring 6 embodied on it, seated annularly on the widened region of the central connection element 3, is designed such that the male thread embodied on the central connection element 3 can easily be reached with a tool; the nut received on it is also rotatable on the male thread, and when a tool engages the area no problems can arise.

For receiving the lock nut 4, which with an annularly configured union ring 6 acts upon the widened region of the central connection element 3, a male thread 7 is provided, which cooperates with the female thread embodied on the lock nut 4.

Extending below the widened region of the central connection element 3 is an extension, made with a diameter d3 (reference numeral 14), of the central connection element 3. This extension is pierced by a bore in its wall, acting as an inlet throttle 10, by way of which a control chamber 11, surrounding the extension of the central connection element 3, containing a fuel supply acting as a control volume can be acted upon. In the control chamber 11, which is defined on one side by a widened annular face of the central connection element 3 and on the other by the valve body 15, supported movably on the extension of the central connection element 3, there is a sealing spring 12, whose ends are braced on the two aforementioned annular faces. The control chamber 11, acted upon by a control volume of fuel via the inlet throttle 10, communicates with an outlet line 32 through control element 17, via an outlet throttle 20 provided on the outlet side. The control element 17 can be embodied either as a piezoelectric actuator or an electromagnet, or as a mechanical/hydraulic converter, by way of which the control chamber 11 can be pressure-relieved. To that end, in a bore on the outlet side that discharges for instance into the fuel reservoir of a motor vehicle, a spherically embodied closing element 19 is provided. This spherical closing element 19 is acted upon in turn by a pressure bolt, which is acted upon in the action direction 18 by the actuator, not shown here, whether it is a piezoelectric actuator or an electromagnet. When the control element 17 is not triggered, the force in the action direction 18 is applied to the pressure piston and as a result forces the spherically embodied closing element 19 into its seat face, and as a result the outlet, or the outlet throttle 20, of the control chamber 11 remains closed, so that the pressure prevailing in the high-pressure collection chamber is applied continuously in the control chamber 11 via the inlet throttle 10.

The valve body 15 is received displaceably on an extension embodied in the diameter region d3 of the central connection element 3, see reference numeral 14. The valve body 15 includes a transverse bore 22, which communicates with the inlet bore 9 of the central connection element 3, and as a result the entire valve chamber 21 is always subjected to fuel at high pressure. On its lower end, the valve body 15 is pressed with a sealing edge 23 into its sealing seat, embodied in the injector housing 2, having the diameter d1 (reference numeral 24), and as a result the inlet line 29 to the injection nozzle, not identified here by reference numeral, is closed. In the state shown, the valve body 15 is in a position in which the injection nozzle is pressure-relieved, via the inlet line 29 to the leaking oil chamber 28. Below the orifice of the inlet line 29 in the injector housing 2, there is a control slide 25, embodied on the valve body 15 that is guided in the injector housing 2. An annular control edge 26 extending all the way around is provided on the control slide 25 and in turn cooperates with a control edge 27 provided on the injector housing 2. Upon pressure relief of the control chamber 11 by actuation of the control element 17, the valve body 15 moves vertically upward, counter to the action direction of the sealing spring 12, and fuel at extremely high pressure flows via the valve chamber 21, through the opened sealing edge 23, and via the inlet line 29 to the injection nozzle. When the valve body 15 moves upward counter to the action direction of the sealing spring 12, the cooperating control edges 26 and 27 on the control slide 25 close the leaking oil chamber 28 provided on the outlet side, so that a short circuit between the outlet-side hollow chamber 28 and the valve chamber 21, in which there is fuel at high pressure, can be effectively averted. The hollow chamber 28 below the control slide 25 forms a leaking oil chamber 28, which communicates via a bore 31 with the outlet line 32 into which the control chamber volume is removed, which volume emerges from the control chamber 11 upon pressure relief of the control chamber 11 through the outlet throttle 20.

Guide faces 30 for a tool to engage are located on the control slide 25 that is embodied below the sealing seat diameter 24 embodied as the diameter $d_1$.

The valve body 15, which is guided on the extension of the connection element 3 at its diameter $d_3$ (reference numeral 14) is embodied with the diameter $d_2$ (reference numeral 16); the two diameters $d_3$ and $d_2$ and the diameter at the seat of the valve body 15 are all adapted to one another. The sealing force which is brought to bear by the sealing spring 12 is relatively slight, compared to known arrangements of fuel injection injectors. The sealing spring 12 is dimensioned such that in adaptation to the annular surface area resulting from the difference in diameter between $d_2$ and $d_3$, the corresponding result is the sealing seat diameter $d_1$, indicated by reference numeral 24. The force additionally brought to bear by the sealing spring 12 must be so great that by means of the control volume, contained in the control chamber 11, of fuel that has entered this chamber through the inlet throttle 10, the force acting on the valve body 15 is so great that in the closed state of the control element 17 and fuel present in the valve chamber 21, a sealing seat of the valve body 15 with its sealing edge on the high-pressure side in the injector housing 2 is always assured. The length of the extension, extending axially to the line of symmetry of the central connection element 3, in the diameter $d_3$ (reference numeral 14) limits the maximum travel distance of the valve body 15 along its guide face of the extension on the central connection element 3.

In the variant embodiment shown, the control element 17, whether it is a piezoelectric actuator or an electromagnet or some other closing element that can be used, is provided laterally in the injector housing 2. Instead of the lateral disposition of the control element 17, this element can also be provided externally on the injector housing 2, or can be integrated with the interior of the injector housing 2 of the injector 1.

Via the inlet 29 to the injection nozzle, the fuel that is at high pressure reaches the combustion chambers of an internal combustion engine; the injection nozzle itself is not shown in the depicted FIGURE. The same is true for the showing of a high-pressure collection chamber, of which only the male thread for connection of the line leading from the high-pressure collection chamber (common rail) to the connection element 3 is shown.

The foregoing relates to a preferred exemplary embodiment of the invention, it being understood that other variants and embodiments thereof are possible within the spirit and scope of the invention, the latter being defined by the appended claims.

I claim:

1. In an injector for injecting fuel which is at high pressure within a high-pressure collection chamber into the combustion chambers of an internal combustion engine, the injector having an injector housing (2), a valve body (15) which opens and closes a valve chamber (21), from which valve chamber an injection inlet (29) extends to an injection nozzle, and to actuate the valve body (15), a control chamber (11) is positioned in the injector housing (2), which control chamber (11) can be pressure-relieved by means of a control element (17), the improvement wherein a high pressure inlet (5, 9), originating at the high-pressure collection chamber, extends centrally through the valve body (15).

2. The injector according to claim 1, wherein the high pressure inlet (5, 9) supplies the control chamber (11) and the valve chamber (21) in the injector housing (2) with fuel that is at high pressure.

3. The injector according to claim 2, wherein the high pressure inlet (5, 9) includes a through bore (9), which discharges into the valve chamber (21) of the injector housing (2).

4. The injector according to claim 2, wherein the high pressure inlet (5, 9) includes an inlet throttle (10) that discharges into the control chamber (11).

5. The injector according to claim 1, wherein the high pressure inlet (5, 9) is provided with a threaded connection and is received in stationary fashion in the injector housing (2).

6. The injector according to claim 1, wherein the high pressure inlet (5, 9) has an extension, and the valve body (15) is movably guided by the extension of the inlet (5, 9).

7. The injector according to claim 1, wherein control chamber (11) contains a control volume which is defined by the high pressure inlet (5, 9), supported in stationary fashion in the injector housing (2), and by the movable valve body (15).

8. The injector according to claim 1, wherein the valve body (15) has a high-pressure sealing edge (23) which rests on a sealing seat (24) of the injector housing (2), and closes off the valve chamber (21).

9. The injector according to claim 1, wherein a leaking oil slide (25) with a control edge (26) is mounted on the outlet-side end of the valve body (15) and cooperates with a control edge (27) provided on the outlet side of the injector housing (2).

10. The injector according to claim 1, wherein the high pressure inlet (5, 9) has a sealing edge (13) which is positioned against a seat in by means of a clamping element (4).

* * * * *